United States Patent [19]

Fletcher et al.

[11] 4,178,708

[45] Dec. 18, 1979

[54] FIBER OPTIC VISUAL DISPLAY SYSTEM

[75] Inventors: Paul C. Fletcher, El Cajon; Parviz Soltan, San Diego, both of Calif.

[73] Assignee: The United States of America as represented by the Secretary of the Navy, Washington, D.C.

[21] Appl. No.: 809,146

[22] Filed: Jun. 21, 1977

[51] Int. Cl.[2] ..... G09F 9/32; G09F 13/18

[52] U.S. Cl. ..... 40/451; 340/380

[58] Field of Search ..... 40/547, 451, 452; 340/380, 336 R; 350/96.24, 96.27

[56] References Cited

U.S. PATENT DOCUMENTS

| | | | |
|---|---|---|---|
| 2,382,251 | 8/1945 | Parker et al. | 340/380 X |
| 2,881,976 | 4/1959 | Greanias | 340/380 X |
| 3,169,305 | 2/1965 | Gray | 340/380 X |
| 3,253,274 | 5/1966 | Berman | 340/380 X |
| 3,562,746 | 2/1971 | Aron | 340/380 |
| 3,820,096 | 6/1974 | Himmelsbach | 340/380 X |
| 3,878,399 | 4/1975 | Higuchi et al. | 340/380 X |
| 3,959,729 | 5/1976 | Marchetti | 340/380 X |

FOREIGN PATENT DOCUMENTS

| | | | |
|---|---|---|---|
| 2422853 | 3/1975 | Fed. Rep. of Germany | 40/452 |

*Primary Examiner*—John F. Pitrelli

*Attorney, Agent, or Firm*—R. S. Sciascia; G. J. Rubens

[57] ABSTRACT

Fiber optic cables are employed to convert punched card type of input information to an alpha-numeric visual display. Separate groups of the fiber optic cables have first terminal ends positioned in an aperture area corresponding to the punched card aperture area. The second terminal ends of each group of fiber optic cables defines a single segment of an alpha-numeric character in a uniform multi-segment format. When a punched card or punched tape type of input information is inserted between a suitable source of light energy and the first terminal ends of the groups of fiber optic cables, those aperture areas which are punched out permit the transmission of light from the light source to the visual display, thereby illuminating corresponding segments of characters in the uniform multi-segment format at a display plane and converting the punched card information to alpha-numeric visual display.

3 Claims, 4 Drawing Figures

FIBER OPTIC VISUAL DISPLAY SYSTEM

BACKGROUND OF THE INVENTION

Many tasks, projects, and business undertakings develop a sequence of statistical facts which can be most helpful in guiding and determining their future progress. As such facts and statistics are chronologically developed, it has been the practice to update the status of each such plan, project, or undertaking by visual displays of varying kinds. Managers of such endeavors desirably require visual display of quantitative data and other information developed by computers, for instance, which are indicative of the up-to-date, current status of each such task, project, or endeavor.

In the past, such updated quantitative and related information has been displayed by alpha-numeric displays which are often of the "snap-rail" or magnetic variety. Both of these methods of visually displaying alpha-numeric information required manual installation, however, which inherently involves the possibility of human error in transition from the information source to the visual display.

Moreover, the periodic replacement of each character in the display is generally required to maintain the visual display in a current, up-to-date condition. Computer-developed information is often available daily or on a more frequent basis; accordingly, the task of transposing such computer generated information to a prior art visual display of the snap-rail or magnetic variety required considerable man-hours of effort, in addition to entailing the possibility of human error in making such transposition.

It is, therefore, highly desirable that a visual display system be provided for transposing and transforming computer developed type of information to an immediate and accurate visual display that may be instantaneously updated upon the availability of the information from its source, such as a computer, for example.

SUMMARY OF THE INVENTION

The concept of the present invention envisions the employment of fiber optic technology to adapt computer produced information, such as may be provided by a conventional standard punched card output from a computer, to a highly readable instantaneous visual alpha-numeric display. The present invention employs groups of fiber optic cables which are coordinated at one terminal end with particular aperture areas and at the other terminal end of each group with particular segments of characters within a uniform, multi-segment format.

Accordingly, the fiber optic visual display system of the present invention employs a source of light energy, such as a fluorescent tube, for example, which typically may provide long-life of the order of 7500 hours. A pluarlity of fiber optic cables transmits the light energy from its source to the visual display.

Discrete groups of the fiber optic cables transmit light energy from corresponding aperture areas contiguous to the source of light energy to a particular segment of each character as defined within a uniform multi-segment format such as, for example, a seven-segment format which will provide all numerics. The discrete groups of fiber optic cables have their first terminal ends disposed in columns and rows of separate aperture areas spatially positioned contiguous to the source of light energy. The second terminal ends of the discrete groups of fiber optic cables are arranged in a display plane for separately defining each segment of each character in the uniform, multi-segment format.

A punched opaque means has columns and rows of aperture areas corresponding to the aperture areas contiguous to the light source and, when inserted between the first terminal ends of the fiber optic cables and the source of light energy, selectively punched out aperture areas determine the transmission of light energy to segments of the multi-segment character format of the display plane, visually presenting multi-character alpha-numeric information which is a transposition of the information contained in a computer produced punched card or punched tape, for example.

Accordingly, it is a primary object of the present invention to provide an improved alpha-numeric visual display system employing the advancements of fiber optic technology.

Another most important object of the present invention is to provide a means of transposing punched card and punched tape computer generated information to an immediate, instantaneous visual alpha-numeric display.

A further object of the present invention is to provide a means of transformation from punched card or punched tape form to a visual display which minimizes the introduction of human error in such transposition.

A further object of the present invention is to provide a fiber optic display which is readily readable in virtually all types of ambient light conditions.

Yet another object of the present invention is to provide such a fiber optic visual display system which has extremely long life and is virtually maintenance free.

These and other features, objects, and advantages of the present invention will be better appreciated from an understanding of the operative principles of a preferred embodiment as described hereinafter and as illustrated in the accompanying drawings.

DESCRIPTION OF THE PREFERRED EMBODIMENTS

Figure 1:
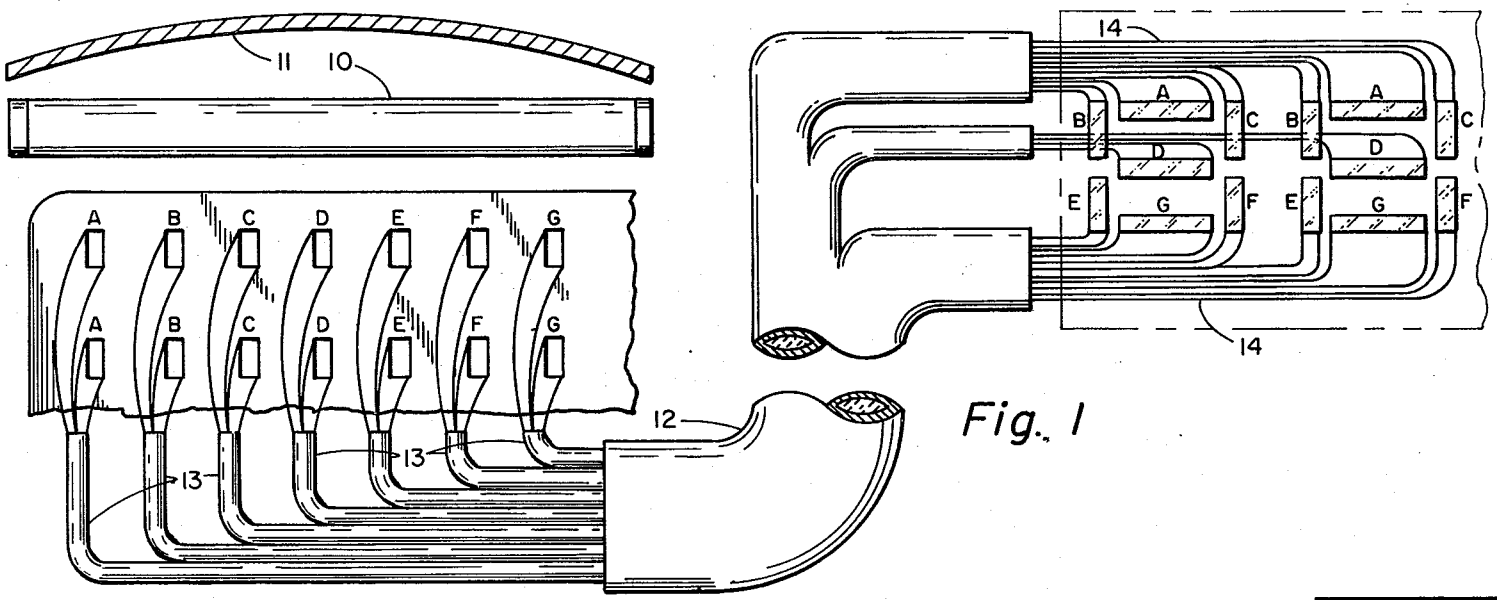
FIG. 1 is a schematic representation of one embodiment of the present invention.

FIG. 1 is an illustration of one embodiment of the present invention comprising a fiber optic visual display system for alpha-numeric displays in a uniform multi-segment format having seven separate illuminateable segments to each alpha-numeric character.

A source of light energy 10 is positioned near a reflector 11 to minimize light losses. A plurality of fiber optic cables 12 have multiple first terminal ends 13 disposed to transmit light energy from the light source 10 to second terminal ends 14 which are arranged in a multiple character alpha-numeric display plane, only part of which is shown. It should be noted that each character in the alpha-numeric visual display plane is definable within a uniform multi-segment format comprising the elements A, B, C, D, E, F and G, i.e., a seven-element, uniform multi-segment format.

Discrete groups of the fiber optic cables have their first terminal ends 13 disposed in columns and rows as shown in FIG. 1 which comprise separate aperture areas positioned contiguous to the source of light energy 10. The second terminal ends 14 of the same discrete groups of fiber optic cables are arranged in the display plane for separately defining each separate segment of each character in the uniform, multi-segment format.

An opaque means, such as a punched card or a punched tape, is adapted to be inserted between the first terminal ends 13 and the source of light energy 10, thereby selectively determining the transmission of light energy in accordance with the punched out aperture areas so that desired segments of each multi-segment character in the display plane are illuminated, visually presenting multiple character alpha-numeric information.

Figure 2:
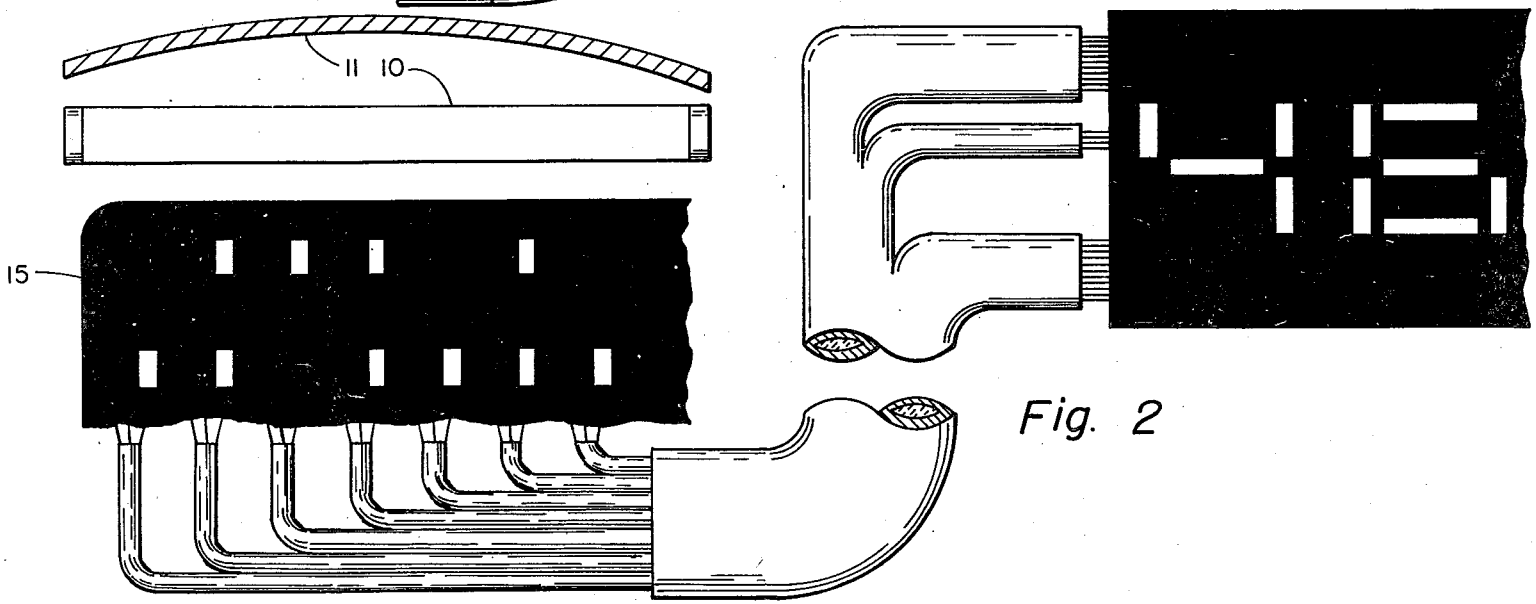
FIG. 2 is a schematic representation of the embodiment of FIG. 1 in actual operation.

FIG. 2 illustrates the results upon the insertion of a punched card or punched tape 15 (illustrated partially for ease of explanation and understanding) in the embodiment illustrated in FIG. 1. It should be noted that groups of seven aperture areas are provided for each character to be represented in the visual display. In FIG. 2 the numerics "46" are visually displayed by illuminated terminal ends of fiber optic cables corresponding to the punched out aperture areas on the punched card 15; the portion of the punched card shows aperture areas B, C, D, and F in the top row are punched out providing a "4" for the first character; the aperture areas A, B, D, E, F, G are punched out in the second row to provide the second character which is a "6". The punched card or punched tape is opaque so that it effectively blocks light transmission through any of the other aperture areas, thus the illumination presented has high contrast and is viewable in any virtually any ambient light conditions.

Figure 3:
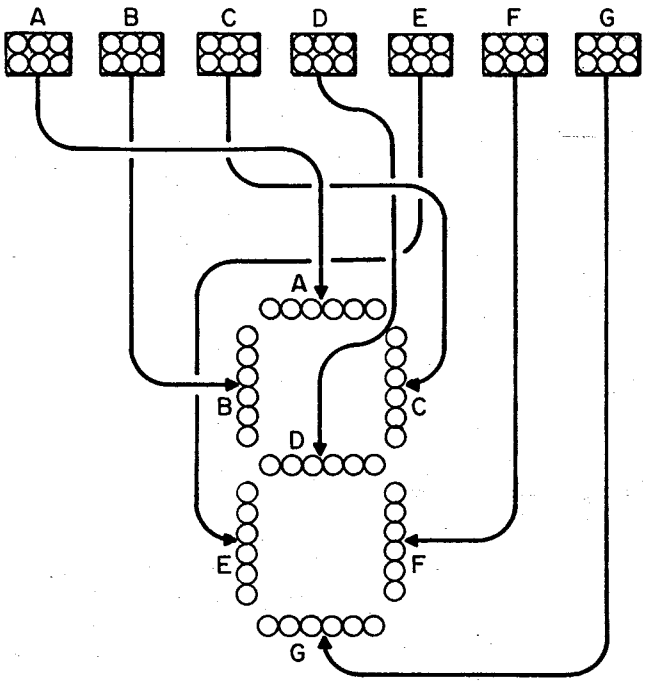
FIG. 3 is a greatly enlarged view showing interelationships between an operative portion of the present invention; and, FIG. 4 is a tabulation of the relationships of selectively punched out aperture areas to active segments of the mutli-segment format for numeric visual display employed in the present invention.

FIG. 3 schematically illustrates the separate groups of fiber optic filaments which may be aligned with the aperture areas A, B, C, D, E, F, and G in their respective relationships with the segments A, B, C, D, E, F, and G which may be illuminated in a seven segment format.

The punched card or punched tape which is inserted between the light source 10 and the fiber optic terminal ends, which are preferably arranged in rows and columns, is determinative of the transmission of light energy to the visual plane and therefore determinative of the alpha-numeric figures that are illuminated and displayed in the visual plane.

Figure 4:
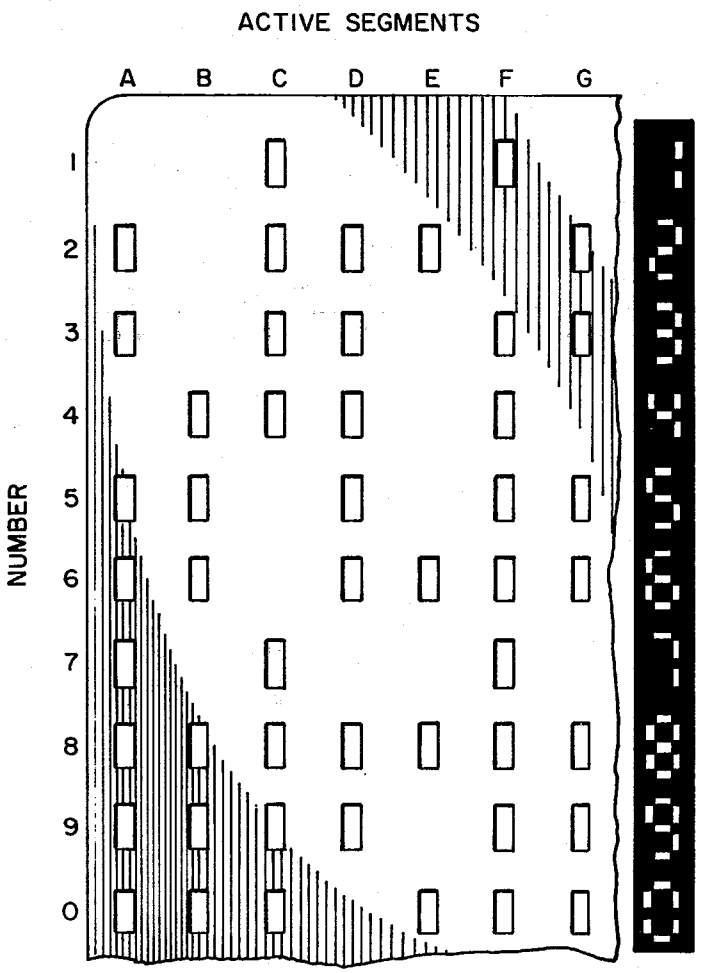

FIG. 4 shows a small end-portion of a typical computer generated punched card illustrating the digits 1, 2, 3, 4, 5, 6, 7, 8, 9, and 0 which may be shown in the visual display plane in accordance with the coded punched card. Those skilled and knowledgeable in the computer arts will readily appreciate that most, if not all, computers producing punched card output information may be readily programmed to deliver numerical information of the kind illustrated in FIG. 4 in terms of seven-segment uniform formats as illustrated in FIGS. 3 and 4. One such standard type punched card generated by a computer is comprised of twelve rows and eighty columns. Thus, in a preferred embodiment of the present invention where a seven-segment uniform visual display format is employed, the punched card areas may be divided into groups of seven within each row, with the eighth column in each row remaining unused to provide separation between the different characters it may be desired to display. Such a computer generated punched card of the conventional type provides more than adequate room for the punched card coded output to display digital information and as a matter of fact in actual practice a portion of the eighty-column, twelve-row, standard computer punched card may remain unused. It is desirable that such cards have a printed or distinctly shaped indicia, on one corner, for instance, to insure proper orientation when inserted.

It will be readily appreciated by those skilled and knowledgeable in the pertinent arts that although the foregoing description and explanation illustrative of the concept of the present invention has been restricted to a seven-segment type of numeric display, alpha-numeric figures may readily be displayed within the concept of the present invention by the selective illumination of fiber segment terminal ends using more fiber optic segments per character format and by employing a correspondingly increased number of groups of punched card apertures to accommodate the increased segments of the alpha-numeric characters.

In consideration of the fact that the prior art and present status boards commonly in use must be updated by translation of notes, receipts, computer printouts, etc. and then finalized by manual insertion and alteration of the information on the board which may require as much as several hours depending on the information density and the cyclic updating, the concept of the present invention offers many advantages. As will be appreciated by an understanding of the foregoing explanation and disclosure of the present invention, the simple insertion of a pre-punched computer card into the fiber optic visual display system of the present invention updates the visual display of a status board, for instance, within seconds thus minimizing labor, reducing costs, eliminating entirely the tedious processes currently required and, most importantly, completely obviating the possibility of human error in transposition of the information from one form to another.

It will be readily apparent to those knowledgeable and skilled in the pertinent arts that the concept of the present invention embraces an automatic version in which punched tapes or punched cards may be continuously threaded through the system as the information is being punched on-line, so that the visual display will be directly and automatically updated with current information by live computer outputs.

Moreover, though the concept of the present invention has been explained in terms of illumination at a visual display plane in terms of "white light", the outputs of the visual display plane may readily be color-coded by the overlay of transparent plastic films, for example, coded with the colors as desired for each particular portion of the information shown at the visual display plane.

Obviously many modifications and variations of the present invention are possible in the light of the above teachings. It is therefore to be understood that within the scope of the appended claims the invention may be practiced otherwise than as specifically described.

What is claimed:

1. A low cost fiber optic visual display system having the capability to be rapidly updated comprising:

a source of light energy;

a plurality of fiber optic cables having first terminal ends disposed to transmit light energy from said source to second terminal ends arranged in a multiple character alpha-numeric display plane, each character being definable within a uniform multi-segment format such as seven segments arranged in a double rectangular configuration;

discrete groups of said fiber optic cables having their first terminal ends disposed in juxtaposed columns and juxtaposed rows of separate aperture areas spatially positioned contiguous to said source of light energy;

second terminal ends of said discrete groups of fiber optic cables arranged in said display plane for separately defining each segment of each character in said uniform multi-segment format; and a computer produced punched card adapted to be rapidly and completely inserted between said first terminal ends and said source of light energy, and having columns and rows of aperture areas corresponding to said separate aperture areas, with selectively determined punched out aperture areas produced by information developed in a computer for permitting the transmission of light energy therethrough to illuminate desired segments of characters in said uniform multi-segment character format in said display plane whereby to visually present alpha-numeric information.

2. A fiber optic visual display system as claimed in claim 1 wherein said computer is programmed to produce its output information in the form of punched out aperture areas in a card in conformance with said column and rows of separate aperture areas to produce said visual display of alpha-numeric characters in said uniform multi-segment format.

3. A fiber optic visual display system as claimed in claim 1 wherein the characters shown in said display plane are selectively color-coded.

* * * * *